US006153294A

United States Patent [19]

Patton et al.

[11] Patent Number: 6,153,294

[45] Date of Patent: Nov. 28, 2000

[54] LOW COST DEEP WATER EFFICIENT BUOYANCY

[75] Inventors: Edward Matthew Patton, Boerne; Jerry Allen Henkener, Canyon Lake; Lawrence Jon Goland; Timothy Stewart Rennick, both of San Antonio, all of Tex.

[73] Assignee: Saipem S.p.A., Milan, Italy

[21] Appl. No.: 09/035,423

[22] Filed: Mar. 5, 1998

[51] Int. Cl.[7] ..... B32B 3/26; B32B 5/16

[52] U.S. Cl. ..... 428/312.8; 428/313.9; 428/218

[58] Field of Search ..... 428/312.8, 313.9, 428/218

[56] References Cited

U.S. PATENT DOCUMENTS

| | | |
|---|---|---|
| 3,477,967 | 11/1969 | Resnick . |
| 3,622,437 | 11/1971 | Hobaica . |
| 3,669,912 | 6/1972 | Hinton . |
| 3,703,012 | 11/1972 | Mast et al. . |
| 3,773,475 | 11/1973 | Madden, Jr. . |
| 3,856,721 | 12/1974 | Fritschel . |
| 4,021,589 | 5/1977 | Copley . |
| 4,255,524 | 3/1981 | Dawans et al. . |
| 4,482,590 | 11/1984 | Bouley et al. . |
| 4,568,389 | 2/1986 | Torobin . |
| 4,568,603 | 2/1986 | Oldham . |
| 4,598,106 | 7/1986 | Utsugi . |
| 4,861,649 | 8/1989 | Browne . |
| 5,041,472 | 8/1991 | Myer . |
| 5,218,016 | 6/1993 | Jarrin et al. . |
| 5,432,205 | 7/1995 | Arnold, Jr. et al. . |
| 5,665,787 | 9/1997 | Nowak et al. . |
| 5,691,390 | 11/1997 | Harrison et al. . |

FOREIGN PATENT DOCUMENTS

| | | |
|---|---|---|
| 2167017 | 5/1986 | United Kingdom . |

*Primary Examiner*—Jerry D. Johnson
*Attorney, Agent, or Firm*—Paula D. Morris & Associates, P.C.

[57] ABSTRACT

The present invention is directed to the formation of pressure resistant buoyancy structures with a given buoyancy efficiency at smaller sizes. The invention involves embedding into syntactic foam metallic spheres which preferably are substantially hollow and comprise high strength, high performance, light weight metal alloys which can be precision forged. The weight per unit space of the metallic spheres is less than that of the syntactic foam. As a result, the metallic spheres can decrease the size of the structure required to achieve a desired buoyancy efficiency.

20 Claims, 2 Drawing Sheets

LOW COST DEEP WATER EFFICIENT BUOYANCY

FIELD OF THE INVENTION

The present invention relates to moldable subsea buoyancy comprising high strength thin walled metallic spheres cast into syntactic foam to decrease the dry weight of the syntactic foam casting and to reduce the size of the resulting flotation device.

BACKGROUND OF THE INVENTION

All subsea vehicles and most subsea equipment require the use of a flotation system to make the vehicle or equipment either neutrally or positively buoyant. Typically, a castable material called syntactic foam is used for this purpose. This is especially true of subsea vehicles, such as Remotely Operated Vehicles (ROV's), and production oil and gas riser pipes (the piping that conducts oil and/or natural gas from the sea floor to a floating production platform at the surface of the ocean).

Syntactic foam is a mixture of epoxy or other suitable resin with hollow microspheres and sometimes "macrospheres" which typically are made of glass mixed evenly throughout the resin. "Macrospheres" are larger than microspheres, with sizes ranging up to about 3 inches in diameter. The syntactic foam is cast and cured to form a block. Since the resins are liquid at room temperature, the foam can be cast into very complex shapes.

The buoyancy efficiency of syntactic foam is defined as dry weight divided by the weight of a comparable volume of sea water. The smaller the buoyancy efficiency number, the more efficient the buoyancy of the foam. At a rated depth of 3000 meters in the ocean, sufficient buoyancy can be provided if the foam density is roughly half the density of water (0.5 g per cc or 32 pounds per cubic foot). At deeper depths, foam having significantly higher density is required.

This means that—in deeper water—considerably more foam is required to provide the same amount of buoyancy. For an ROV that will operate at 3000 to 6000 meters ocean water depth (10,000 to 20,000 feet), the amount or size of the block of syntactic foam required to provide a desired amount of buoyancy can become a significant problem. At a design depth of 6000 meters, a typical Work Class ROV would require a foam block nearly twice as large as the foam block that would be required at 3000 meters.

In addition to the problem of size, syntactic foam also is relatively expensive and lighter weight syntactic foams with greater buoyancy efficiency are subject to crushing at the pressures encountered in deep water. Syntactic foams are needed which are less expensive, which have increased buoyancy efficiency, and which have greater resistance to crushing in deep water.

SUMMARY OF THE INVENTION

The present invention solves these problems by providing a pressure resistant buoyancy structure comprising a block of syntactic foam comprising embedded metallic spheres comprising a weight per unit space less than the syntactic foam, wherein said pressure resistant buoyancy structure has a buoyancy efficiency and said embedded metallic spheres have a strength sufficient to maintain said buoyancy efficiency under pressures to which the structure will be exposed during use.

DETAILED DESCRIPTION OF THE INVENTION

Figure 1:
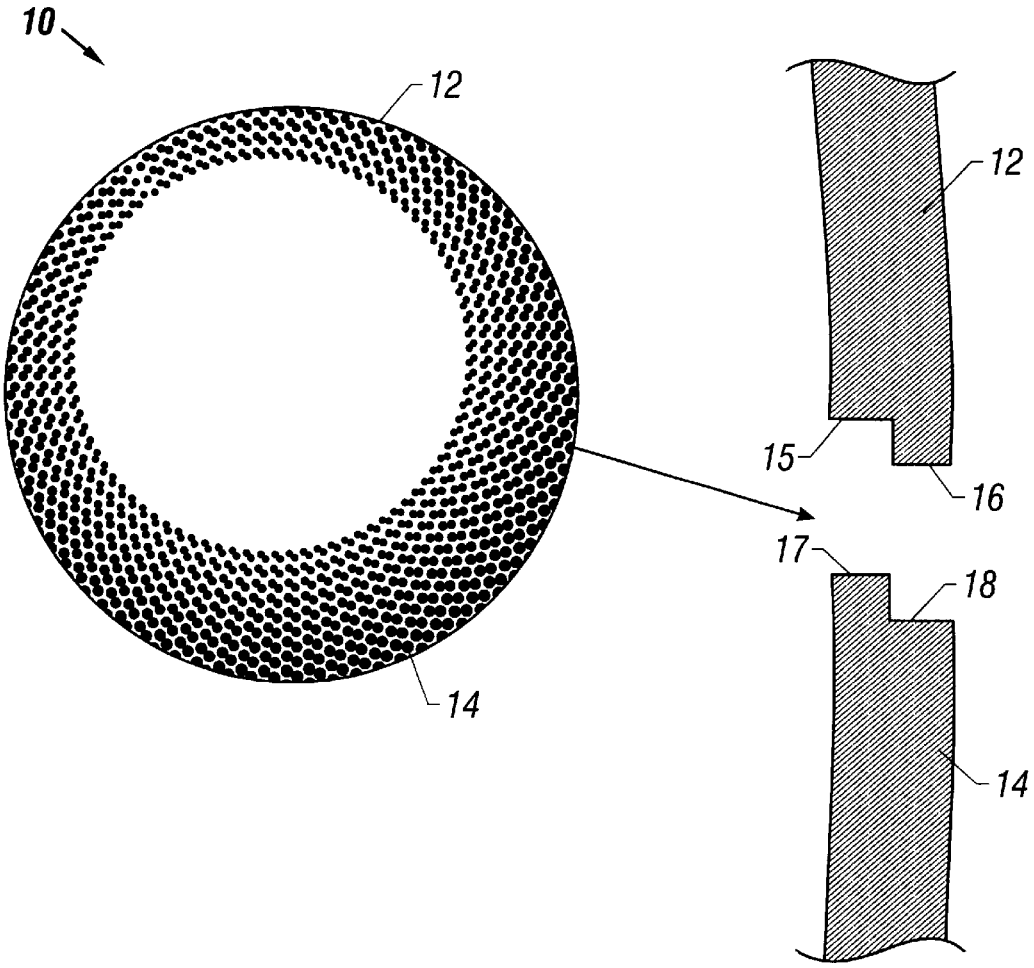
FIG. 1 is a perspective view of a metallic sphere of the present invention with an exploded cross sectional view of preferred edge connection detail for each hemisphere.

The invention consists of the manufacture of low cost, high strength, light weight, preferably relatively large diameter hollow metallic spheres that can be cast directly into a syntactic foam block. The spheres are lighter in weight per unit space than the foam that they replace, but cost approximately the same as the foam that they replace.

The spheres may be made of any high performance engineering structural metal that can be precision forged. Suitable metals include, but are not necessarily limited to aluminum and its alloys, steel, and titanium and its alloys. A preferred metal, for reasons of both cost and workability, is a high strength aluminum alloy such as 7075 or 7175, or one of the 7050 series alloys.

The spheres preferably are manufactured by forging two hemispheres, machining the connection between the two hemispheres to allow them to be joined together, and then casting the hollow spheres into a block of syntactic foam. The diameter and thickness of the sphere is determined by the depth requirement for the buoyancy foam. The spheres may have substantially any diameter; however, for deepwater environments of over 3000 meters, preferred diameters will range from about 10 inches to about 24 inches. The hydrostatic pressure due to water at 3000 meters is about 296 $kg/cm^2$ (4200 psi), and the stress in a block of syntactic foam at 3000 meters also is about 296 $kg/cm^2$ (4200 psi). However, because the metal spheres are hollow and have a very thin wall, the stress in the wall of the metal spheres will be more in the range of about 4932 $kg/cm^2$ (70,000 psi). The crush pressure for the syntactic foam is about 423 $kg/cm^2$ (6000 psi), but in the sphere, the crush pressure is more in the range of about 7046 $kg/cm^2$ (100,000 psi). Persons of ordinary skill in the art will recognize that 7046 $kg/cm^2$ (100,000 psi) is more stress than the metal spheres are supposed to be capable of withstanding, but since the spheres are supported by the foam, and since the foam is in compression, the spheres withstand the stress. The safety factor is calculated as 1.5.

In order to achieve at least these strengths in a syntactic foam containing the hollow metallic spheres of the present invention, the walls of spheres having a diameter of about 10 inches must have a thickness of at least about 0.15 inches, preferably in the range of from about 0.14 to about 0.16 inches. The spheres preferably should have roughly the same bulk modulus as the syntactic foam into which they are cast in order to keep interfacial stresses to a low level.

The two hemispheres may be forged using a number of procedures, a preferred procedure being isothermal precision forging. In isothermal precision forging, a forging die with the desired hemispherical configuration is prepared. A blank of the metal to be forged is placed in the forging die, and both the forging die and the blank of metal are held at the same elevated temperature. The elevated temperature preferably should be sufficiently high to render the metal blank malleable enough for molding by the dies. Each metal alloy has a preferred temperature range for isothermal precision forging. The dies are closed on the blank of metal relatively slowly. Once the dies are closed, high tonnage is supplied on the dies to form the hemisphere. The hemispheres are then rough machined and heat treated according to the appropriate heat treating schedule for the alloy used. Persons of ordinary skill in the art will know the appropriate heat treating schedule. Typical heat treating schedules are available from the metal supplier, are described in the *Metals Handbook,* Vol. 5 (9th Ed. 1982), incorporated herein by reference, and are described in various texts related to forging.

After heat treating, the hemispheres are machined into their final shape by putting on edge connection detail to connect the two hemispheres. Although various edge connection configurations may be used, a preferred edge detail is shown in FIG. 1.

Figure 2:
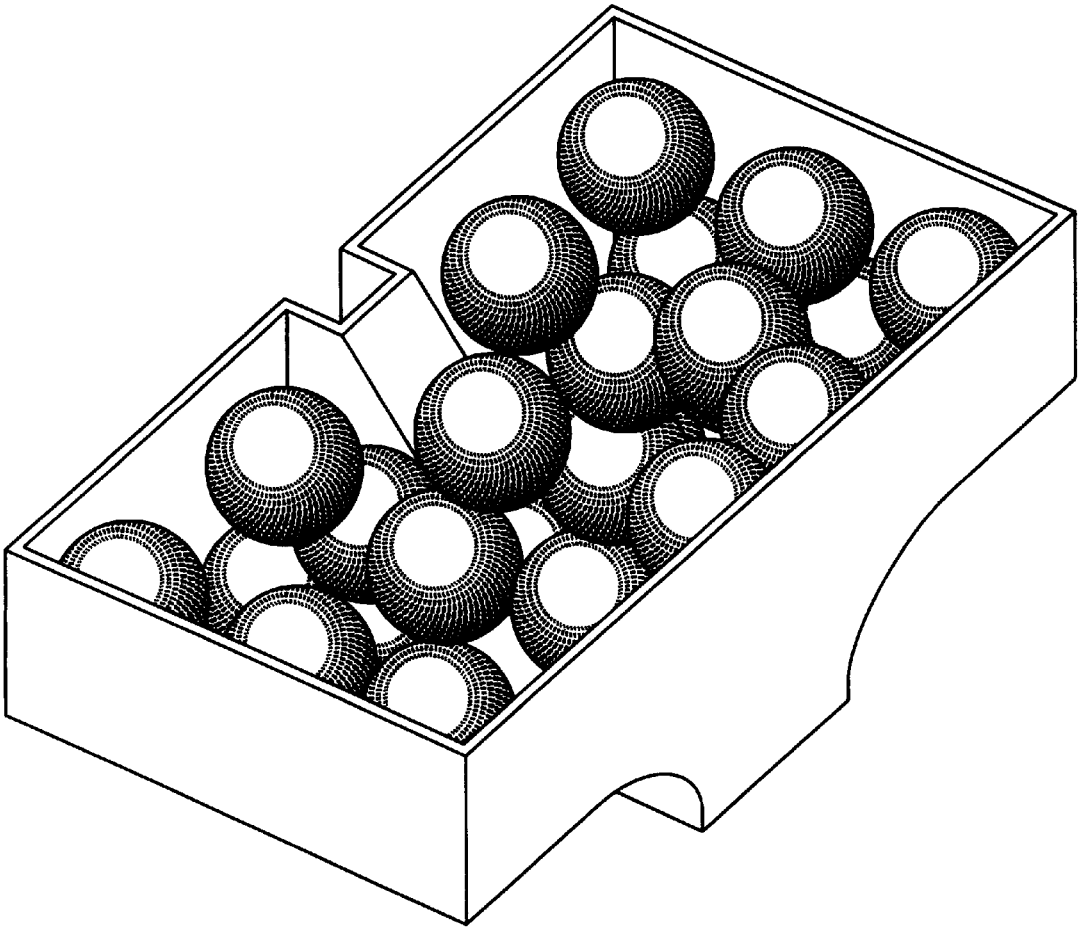
FIG. 2 is a perspective view of a buoyancy block loaded with metallic spheres according to the present invention.

Referring to FIG. 1, each sphere 10 comprises two hemispheres 12, 14. The hemispheres 12, 14 are connected via mating annular shoulders and flanges. A first hemisphere 12 comprises an inner annular shoulder 15 and an outer annular flange 16. A second hemisphere 14 comprises an inner annular flange 17 and an outer annular shoulder 18. The inner annular flange 17 of the second hemisphere 14 mates with the inner annular shoulder 15 of the first hemisphere 12, and the outer annular flange 16 of the first hemisphere 12 mates with the outer annular shoulder 18 of the second hemisphere 14. The inner and outer surfaces of the hemispheres preferably are used in the as forged condition, without additional machining. After machining the edge detail, the two hemispheres 12, 14 are sealed together, preferably with the aid of a suitable adhesive, and the finished sphere is cast into a syntactic foam block. Referring to FIG. 2, a small amount of spacing preferably is provided between spheres to avoid metal-to-metal contact. This spacing may be provided either with spacers glued to the spheres before casting, or a thin coating of the syntactic foam material may be applied and cured before the spheres are arranged in the block mold.

The mold preferably is treated with a suitable release agent before the spheres are fixed in the mold. Examples of suitable releasing agents or release films include, but are not necessarily limited to FREEKOTE 700, 33 NC or 815 NC mold release agents. FREEKOTE is a U.S. federally registered trademark of The Dexter Corp. Thereafter, the spheres may be arranged and fixed in place in the block mold using any suitable means, such as a fixed lid mold 019 fixed grating unit that allows for the flow of syntactic foam but does not allow the spheres to move during casting. In order to maximize buoyancy efficiency, the spheres preferably are arranged in a regular manner at their highest packing density.

After the spheres are fixed in the mold, the entire syntactic foam block is cast as a single unit. The starting materials for making syntactic foam include a suitable resin. The resin may be any suitable resin known to persons of ordinary skill in the art, including, but not necessarily limited to synthetic organic resins such as an epoxy, a cyanate ester, or a polyimide resin. Silicones, bismaleimides, and other thermosetting and thermoplastic resins also may be used. Preferred resins are epoxy resins.

A preferred raw foam is entrained with air, and is commercially available under the name Low Cost Buoyancy Foam from Syntech Materials, P.O. Box 5242, Springfield, Va. 22150. Microspheres or macrospheres (hereinafter "microspheres") are mixed with the foam. Substantially any available microspheres may be used. Suitable microspheres include, but are not necessarily limited to polymer, glass, quartz, or carbon spheres, with preferred spheres being hollow glass spheres filed with a gas such as carbon dioxide and having a diameter in the range of from about 5 to about 200 microns. The microspheres may be mixed with the raw foam using any of the methods known in the art such as, for example, the vacuum mixing method or the vacuum impregnation method. The mixing may be performed either as a batch or continuous process. Once the raw foam and microspheres are thoroughly interspersed, the raw foam may be processed by molding and curing.

The raw foam/microsphere mixture is poured into the mold until the raw foam surrounds and intimately contacts the resin coating or outer surface of the spheres. The mixture then is allowed to cure using known procedures. For a foam made from an epoxy resin where the material will have a thickness in the range of from about two inches to about six inches, the raw material is heated gradually [at a rate of about 0.18° C. (½° F.) per minute] to about 49° C. (120° F.), and held for about two hours, then heated to about 60° C. (140° F.) and held for about two hours, then heated to about 71° C. (160° F.) for up to about four hours. For material thicknesses greater than six inches, the raw material is heated gradually [at a rate of about 0.18° C. (½° F.) per minute] to about 41° C. (105° F.) and held for up to about four hours, then heated to about 49° C. (120° F.) for up to about two hours, then heated to about 60° C. (140° F.) for up to about two hours, then to about 71° C. (160° F.) for up to about four hours. The curing process can take place under a vacuum. If the resin contains entrained air, then the curing process does not take place under a vacuum.

For a given depth rating, a block of syntactic foam having desired buoyancy and strength properties can be made in smaller dimensions using the embedded spheres of the present invention. If the spheres are well forged and intimately bonded to the foam, a block with embedded spheres will have a crush depth that is near the crush depth of a block of syntactic foam without embedded spheres.

The invention will be better understood with reference to the following Example, which is illustrative only, and is not intended to limit the scope of the present invention which is defined by the claims.

EXAMPLE

Preparation of Hollow Metallic Spheres

Five hollow metallic spheres are forged using isothermal precision forging. A forging die is prepared having a diameter of about 10 inches. A blank of about 1450 g 7175 aluminum alloy is placed in the forging die, and both the forging die and the blank of metal are heated to about 370° C. The dies and metal blank are held at that temperature, and the dies are closed on the blank of metal relatively slowly. Once the dies are closed, approximately 2500 tons are supplied on the dies to form hemispheres having a thickness of about 0.15 inches.

The hemispheres are rough machined and heat treated by raising the temperature of the hemispheres to the "solutionizing" temperature, or to the point where the precipitation in the alloy goes back into solid solution in the metal. The hemispheres are then rapidly cooled or "quenched" to ensure that this solution remains. The hemispheres are again heated to an "aging" temperature which is much lower than the solutionizing temperature, for a specified amount of time until the metal reaches its peak strength.

After heat treating, the edge connection detail shown in FIG. 1 is machined onto the edges of the appropriate opposing hemispheres. The inner and outer surfaces of the forging are used in the as forged condition. After machining, the "male and female" edges of the two hemispheres are joined, preferably using a cyanoacrylate adhesive.

Casting of Foam Around the Spheres

The mold is treated with FREEKOTE 700 before the spheres are affixed in the mold. FREEKOTE is a U.S.

federally registered trademark of The Dexter Corp. In addition, a thin coating of the syntactic foam raw material is applied to the outer surface of the spheres and cured before the spheres are fixed in the block mold. The spheres are secured in place preferably using a grate, and are secured in the mold by entirely enclosing the flow mold cavity containing the spheres. In order to maximize buoyancy efficiency, the spheres are fixed in the mold at intervals at their highest packing density.

After the spheres are secured in the mold, raw foam material comprising entrained air obtained from Syntech Materials is poured into the mold and the raw material is heated gradually (at a rate of about 0.18° C. (½° F.) per minute to about 41° C. (105° F.), then heated to about 49° C. (120° F.) for about two hours, then heated to about 60° C. (140° F.) for about two hours, then to about 71° C. (160° F.) for about four hours.

The resulting block withstands hydrostatic pressures up to about 6000 meters, with a safety factor calculated at 1.5 and a buoyancy efficiency of approximately 0.40.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

We claim:

1. A pressure resistant buoyancy structure comprising a block of syntactic foam comprising embedded precision forged metallic spheres comprising a weight per unit space less than said syntactic foam, wherein said pressure resistant buoyancy structure has a buoyancy efficiency and said embedded metallic spheres have a strength sufficient to maintain said buoyancy efficiency at pressures of about 4,200 psi or more.

2. The structure of claim 1 wherein said metallic spheres and said syntactic foam block comprise a substantially equal bulk modulus.

3. The structure of claim 2 wherein said pressure resistant buoyancy structure substantially maintains said buoyancy efficiency at up to about 7046 kg/cm$^2$ (100,000 psi).

4. The structure of claim 1 wherein said metallic spheres are regularly spaced at a highest packing density.

5. The structure of claim 1 wherein said metallic spheres have an inner diameter of at least about 24 cm.

6. The structure of claim 1 wherein said pressure resistant buoyancy structure substantially maintains said buoyancy efficiency at up to about 7046 kg/cm$^2$ (100,000 psi).

7. An apparatus comprising a first pressure resistant buoyancy structure comprising a first block of syntactic foam comprising embedded precision forged metallic spheres, said syntactic foam and said metallic spheres comprising materials and structure effective to produce a first buoyancy efficiency at a first size, said spheres having a strength sufficient to maintain said buoyancy efficiency at pressures of about 4,200 psi or more;

wherein a second pressure resistant buoyancy structure comprising a second block of syntactic foam in the absence of said embedded metallic spheres produces a second buoyancy efficiency equal to said first buoyancy efficiency at a second size which is larger than said first size.

8. An apparatus comprising a first pressure resistant buoyancy structure comprising a first block of syntactic foam comprising embedded metallic spheres, said syntactic foam and said metallic spheres comprising materials and structure effective to produce a first buoyancy efficiency at a first size;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said metallic spheres are substantially hollow and comprise a precision forged high performance engineering structural metal comprising, an aluminum alloy.

9. The apparatus of claim 8 wherein said metallic spheres and said syntactic foam block comprise a substantially equal bulk modulus.

10. The apparatus of claim 8 wherein said metallic spheres are regularly spaced at a highest packing density.

11. The apparatus of claim 8 wherein said metallic spheres have an inner diameter of at least about 24 cm.

12. The apparatus of claim 8 wherein said pressure resistant buoyancy structure substantially maintains said buoyancy efficiency at up to about 7046 kg/cm$^2$ (100,000 psi).

13. An apparatus comprising a first pressure resistant buoyancy structure comprising a first block of syntactic foam comprising embedded precision forged metallic spheres, said syntactic foam and said metallic spheres comprising materials and structure effective to produce a first buoyancy efficiency at a first size, said embedded metallic spheres have a strength sufficient to maintain said buoyancy efficiency at pressures of about 4,200 psi or more;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said metallic spheres comprise a metal comprising an aluminum alloy, wherein said aluminum alloy comprises a series selected from the group consisting of 7075, 7175, and 7050.

14. An apparatus comprising a first pressure resistant buoyancy structure comprising a first block of syntactic foam comprising embedded metallic spheres, said syntactic foam and said metallic spheres comprising materials and structure effective to produce a first buoyancy efficiency at a first size;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said metallic spheres and said syntactic foam block comprise a substantially equal bulk modulus.

15. An apparatus comprising a first pressure resistant buoyancy structure comprising a first block of syntactic foam comprising embedded precision forged metallic spheres, said syntactic foam and said metallic spheres comprising materials and structure effective to produce a first buoyancy efficiency at a first size, said embedded metallic spheres having a strength sufficient to maintain said buoyancy efficiency at pressures of about 4,200 psi or more;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said metallic spheres are regularly spaced at a highest packing density.

16. An apparatus comprising a first pressure resistant buoyancy structure comprising a first block of syntactic foam comprising embedded metallic spheres, said syntactic foam and said metallic spheres comprising materials and structure effective to produce a first buoyancy efficiency at a first size;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said metallic spheres have an inner diameter of at least about 24 cm.

17. An apparatus comprising a first pressure resistant buoyancy structure comprising a first block of syntactic foam comprising embedded metallic spheres, said syntactic foam and said metallic spheres comprising materials and structure effective to produce a first buoyancy efficiency at a first size;

wherein a second pressure resistant buoyancy structure comprising a second block of syntactic foam in the absence of said embedded metallic spheres produces a second buoyancy efficiency equal to said first buoyancy efficiency at a second size which is larger than said first size, wherein said first pressure resistant buoyancy structure substantially maintains said buoyancy efficiency at up to about 7046 kg/cm$^2$ (100,000 psi).

18. A method of reducing the size of a pressure resistant buoyancy structure, for use in deepwater environments, required to achieve a first buoyancy, said method comprising;

forming substantially hollow metal spheres comprising a high performance engineering structural metal said spheres having a strength sufficient to maintain said first buoyancy at pressures of about 4,200 psi or more;

fixing said metallic spheres in a mold for said pressure resistant buoyancy structure; and pouring syntactic foam raw material into said mold and around said metallic spheres; and curing said syntactic foam.

19. A pressure resistant buoyancy structure comprising a block of syntactic foam comprising embedded precision forged metallic spheres comprising a weight per unit space less than said syntactic foam.

20. The pressure resistant buoyancy structure of claim 19 wherein said pressure resistant buoyancy structure has a buoyancy efficiency and said embedded metallic spheres have a strength sufficient to maintain said buoyancy efficiency when said buoyancy structure is submerged in water.

* * * * *